US005320266A

United States Patent [19]

Noé et al.

[11] Patent Number: 5,320,266

[45] Date of Patent: Jun. 14, 1994

[54] STRIP STORAGE ARRANGEMENT WITH INDEPENDENT TENSION CONTROL OF SYNCHRONOUSLY OPERATED SUPPORT CARRIAGES

[75] Inventors: Oskar Noé; Rolf Noé; Andreas Noé, all of Mülheim, Fed. Rep. of Germany

[73] Assignee: BGW Bergwerk-und Wlazwerk-Maschinenbau GmbH, Duisberg, Fed. Rep. of Germany

[21] Appl. No.: 8,045

[22] Filed: Jan. 22, 1993

Related U.S. Application Data

[63] Continuation of Ser. No. 571,775, Aug. 22, 1990, abandoned.

[30] Foreign Application Priority Data

Oct. 28, 1989 [EP] European Pat. Off. ..... 89120073.5

[51] Int. Cl.[5] ..... B65H 20/24

[52] U.S. Cl. ..... 226/119; 226/118; 226/108; 318/7; 318/85

[58] Field of Search ..... 226/118, 119, 108, 111, 226/113, 195; 242/182; 318/7, 85

[56] References Cited

U.S. PATENT DOCUMENTS

| | | | |
|---|---|---|---|
| 3,687,348 | 8/1972 | Schieb | 226/113 |
| 4,360,137 | 11/1982 | Noe et al. | 226/119 X |
| 4,771,621 | 9/1988 | Sato | 226/119 |
| 4,842,178 | 6/1989 | Noe et al. | 226/113 |

*Primary Examiner*—Joseph J. Hail, III
*Assistant Examiner*—Paul T. Bowen
*Attorney, Agent, or Firm*—Anderson Kill Olick & Oshinsky

[57] ABSTRACT

A strip storage arrangement with a strip storage unit in strip treatment plants. The strip storage unit is divided into two or more storage sections. Each strip storage section has its own tension drive. Speed-controlled intermediate strip drives are arranged between the storage sections. The intermediate strip drives apply the bending and friction forces of the preceding storage section, so that the tension input value of the first loop strand of each storage section is equal. The resulting strip storage unit can have any storage capacity and is of simple and operationally safe construction.

4 Claims, 3 Drawing Sheets

STRIP STORAGE ARRANGEMENT WITH INDEPENDENT TENSION CONTROL OF SYNCHRONOUSLY OPERATED SUPPORT CARRIAGES

This is a continuation of application Ser. No. 07/571,775 filed Aug. 22, 1990, in the name of Oskar Noé, Andreas Noé and Rolf Noé, entitled STRIP STORAGE ARRANGEMENT, now abandoned.

BACKGROUND OF THE INVENTION

1. Field of the Invention

The present invention relates to a strip storage arrangement including a strip storage unit for strips, particularly metal strips, which travel continuously in the form of loops in strip treatment units. The strip storage unit includes a strip drive at the entry side, a strip drive at the exit side and at least one tension drive for generating the necessary tension in the loop strands of the strip.

2. Description of the Related Art

In processing plants for e.g. metal strip of steel, aluminum or the like, or for plastic tapes or paper bands and also for foils, wire and the like with continuous operation in the processing unit, it is necessary to provide a strip storage unit each at the entry side and at the exit side for bridging the periods of stoppage when coils or reels are being exchanged. In treatment arrangements of metal strip, the processing unit may be a rolling mill, a break-down unit, a chemical treatment unit, a coating unit, an annealing unit or the like.

Horizontal strip storage units and vertical strip storage units are known in the art. The strip travels through these storage units while forming loops. The individual loops or loop strands are guided over stationary and movable deflection rollers. The movable deflection rollers are arranged on roller tables in the case of vertical storage units and in looping carriages in the case of horizontal storage units. The roller cables or looping carriages are connected to a tension drive which serves to generate the necessary strip tension or the desired tension in the loop strands of the strip.

When the strip travels around the deflection rollers, bending and friction losses occur, particularly when metal strip having a thickness of 1.5 mm to 6 mm is being processed. These bending losses add up from loop strand to loop strand. For structural reasons, the diameter of the deflection rollers is not large enough to permit an elastic travel of the strip around the rollers. For example, in the case of a steel strip having a yield point of 250 $N/mm^2$ and a thickness of 2 mm, a roller diameter of 1680 mm is required. In the case of a strip thickness of 6 mm, the roller diameter must even be 5000 mm. However, for cost reasons and for reasons of space availability, the rollers which are usually used have a diameter of only between 1000 mm and 1500 mm. In rollers having these diameters, extremely high bending and friction losses occur in the range of the above-mentioned strip thicknesses. These losses are unacceptable for technical and economical reasons. Moreover, higher processing speeds and greater strip storage capacities and coils are required to an increasing extent, so that the strip treatment plant or its processing unit can be operated continuously with high strip speed.

SUMMARY OF THE INVENTION

It is the object of the present invention to provide a strip storage unit of the above-described type in which, while maintaining conventional roller diameters of the deflection rollers, the bending and friction losses can be kept under control even when the strip has a substantial thickness. Also, the strip storage arrangement is to make possible a storage capacity of any chosen size and high processing speeds in a simple and operationally safe manner.

In accordance with the present invention, the above object is met by dividing the strip storage unit into two or more storage sections. Each storage section has its own tension drive and intermediate drives for the strips are arranged between the storage sections.

The strip drive at the entry and exit sides as well as the intermediate strip drive may be speed-controlled or tension-controlled.

In accordance with the invention, the bending and friction losses of each storage section are applied by each subsequently arranged speed-controlled intermediate strip drive and are adjusted for the subsequent storage section to the tension input value of the first loop strand of the preceding storage section. The power input of the intermediate strip drive is of such a magnitude as is needed for covering the bending and friction losses of the traveling strip in the respective storage section. They are designed for the maximum occurring tension losses of which the bending and friction losses are a portion.

In accordance with another essential feature of the present invention, at least the intermediate strip drive can be controlled with the intermediate arrangement of a computer in dependence on the speed difference between the strip drive on the entry side and the strip drive on the exit side, so that the respective degree of loading with strip of the storage sections remains approximately equal. The speed difference is measured continuously and processed through a computer for the speeds of the intermediate strip drive. In addition, the degrees of loading of the storage sections are continuously supplied to the computer and are processed for the speed control of the intermediate strip drive.

Differences in the degrees of loading of the storage sections are compensated by means of correction signals for the intermediate strip drives or for the speeds thereof. If the strip storage unit is a vertical storage unit, the storage sections are advantageously arranged each with its own roller table at predetermined distances one behind the other. In the case of a horizontal storage unit, the storage sections are advantageously arranged each with a looping carriage at predetermined distances one above the other.

In accordance with a further feature of the invention, the tension drive for the roller tables or looping carriages are of identical construction and the roller tables or looping carriages are operated synchronously and, when deviations from the synchronous operations occur, the tension drives influence the speed-controlled strip drive or intermediate strip drive through the computer. The synchronous operation of the roller tables or looping carriages of the storage sections can be monitored by measuring the travel distances of the tension drive. Appropriate correction signals are provided from the computer to the strip drive or intermediate strip drive.

The present invention provides the particular advantage that it is now possible to construct strip storage units of any chosen size which are simple and safe to operate. In this connection, strip storage units of any chosen size refers to storage units having any selected capacity while maintaining deflection rollers with conventional roller diameters even when strips and particularly metal strips having significant thicknesses and particularly thicknesses of up to 6 mm are stored. The accumulating bending and friction losses are applied after each storage section by the subsequently arranged intermediate strip drive, so that the same tension inlet value is available for the first loop strand of each storage section.

In accordance with a particularly advantageous feature, strip storage units may be of vertical construction in the form of looping carriages. The vertically suspended loop strands do not have the tendency to travel away and they can be controlled centrally in the known manner. Since all tension drives for the storage sections are the same, it is easily possible to obtain a synchronous control of the roller tables. In the case of different strips, the desired strip tension can be newly adjusted after traveling through each connection point between a storage section and the next storage section, i.e., the individual storage sections can be operated with different strip tensions, while the synchronous operation of the storage sections or the roller tables thereof is maintained. Moreover, it is possible to operate with increased processing speed because the processing unit of the effective strip treatment plant can be operated continuously with high speed.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
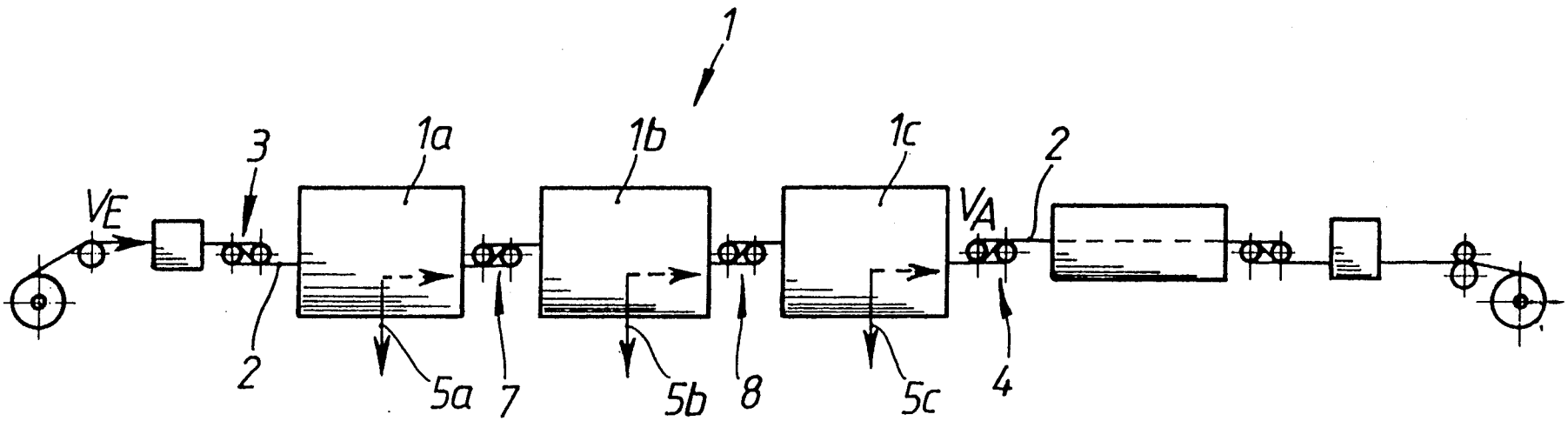
FIG. 1 is a schematic side view of a strip treatment plant including a strip storage unit according to the present invention.

The figures of the drawing show a strip treatment plant with a strip storage arrangement. The strip storage arrangement essentially includes a strip storage unit 1 for strips 2, particularly metal strips, which continuously travel through the strip storage unit 1 in the form of loops. The strip storage arrangement further includes a strip drive 3 at the entry side, a strip drive 4 at the exit side and at least one tension drive 5 for generating the necessary strip tension in the loop strands 6.

The strip storage unit 1 is divided into two or more storage sections 1*a*, 1*b*, 1*c*, etc. In the illustrated embodiments, three storage sections 1*a*, 1*b*, 1*c* are provided. Each storage section 1*a*, 1*b*, 1*c* has its own tension drive 5*a*, 5*b*, 5*c*. Speed-controlled intermediate strip drives are arranged between the storage sections 1*a*, 1*b*, 1*c*. The strip drive 3, 4 at the entry side and at the exit side can also be speed-controlled.

Figure 2:
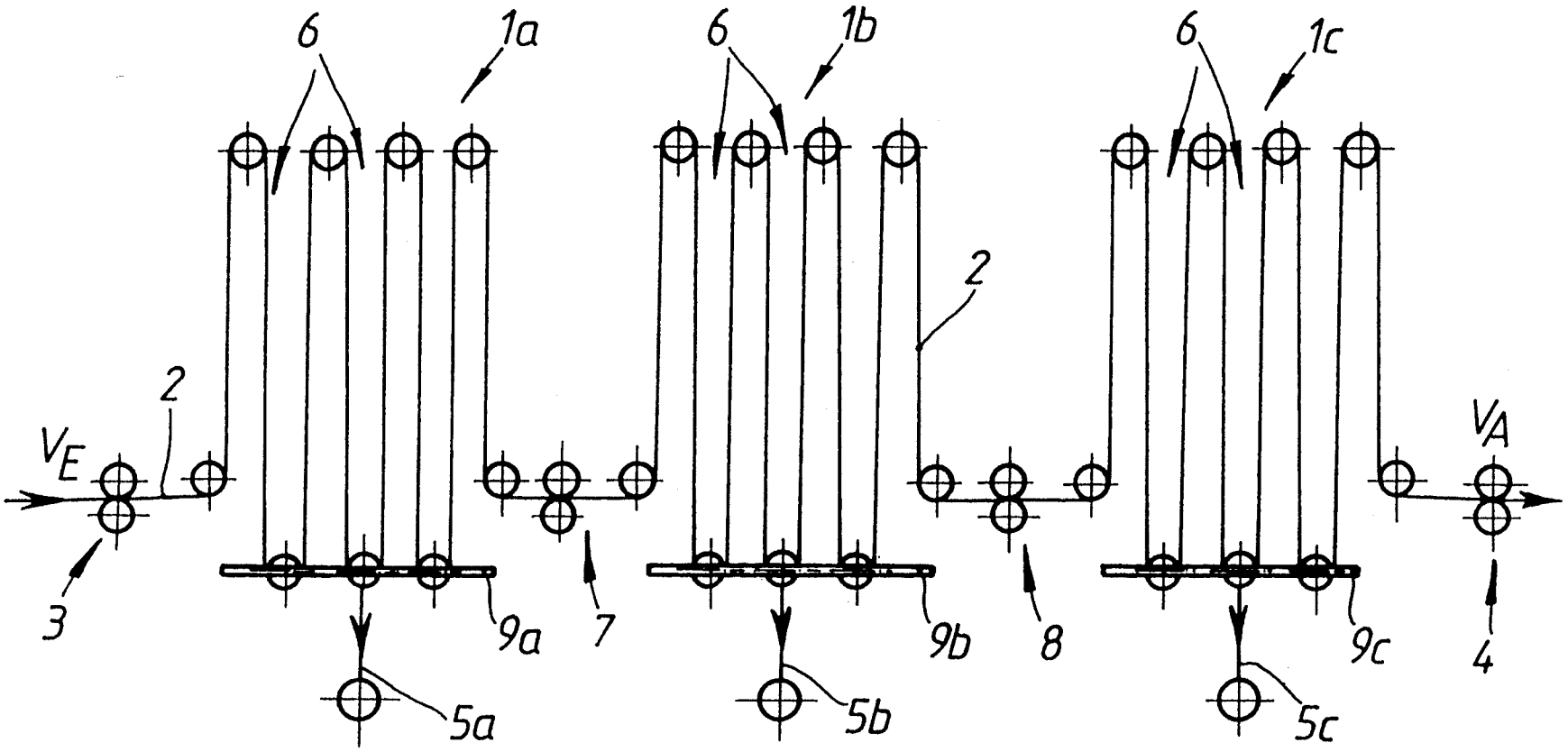
FIG. 2 shows a detail of FIG. 1 with a vertical-type strip storage unit.
Figure 3:
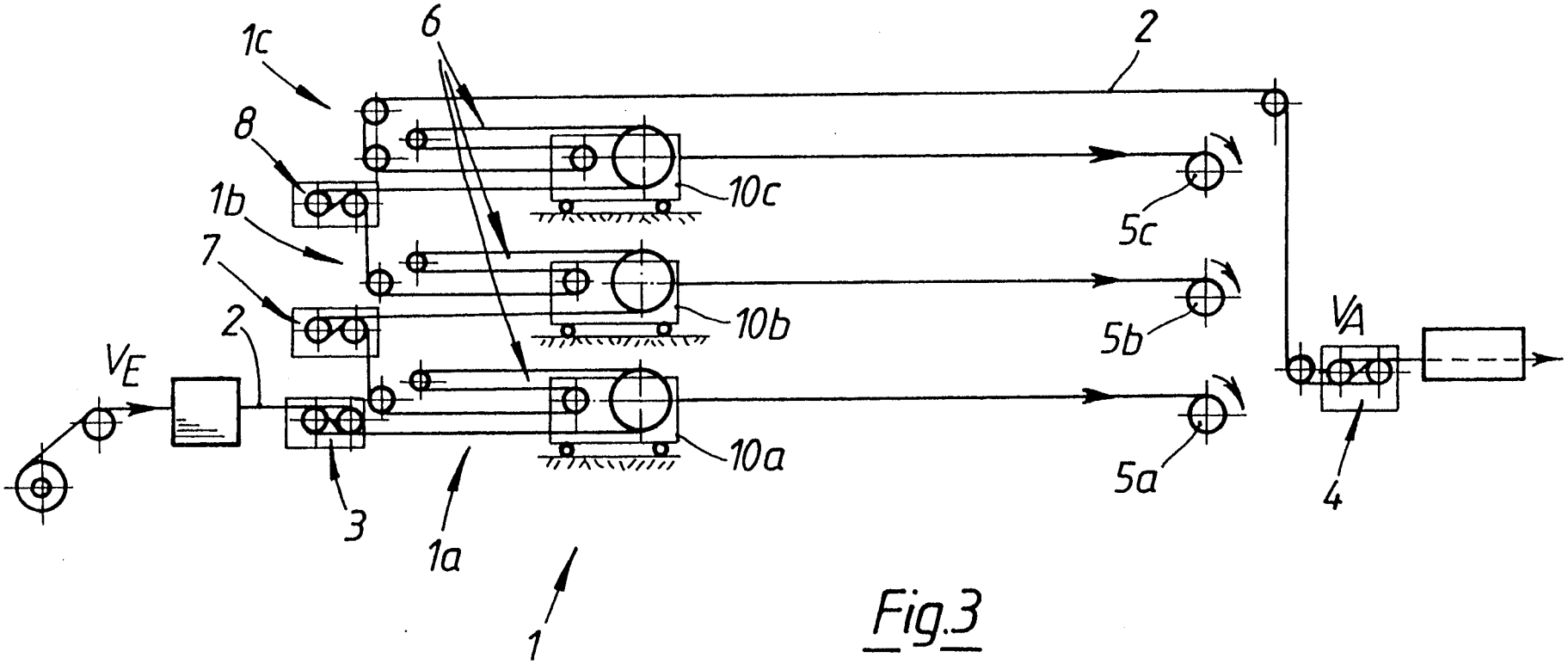
FIG. 3 shows a detail of FIG. 1 with a horizontal-type strip storage unit.

In the embodiment shown in FIG. 2 with vertical storage, the storage sections 1*a*, 1*b*, 1*c* are each arranged in a separate roller table 9*a*, 9*b*, 9*c* at predetermined distances one behind the other. In the embodiment shown in FIG. 3 with horizontal storage, the storage sections 1*a*, 1*b*, 1*c* are each arranged with its own looping carriage 10*a*, 10*b*, 10*c* at predetermined distances one above the other.

At least the intermediate strip drives 7, 8 can be controlled in dependence on the speed difference between the strip drive 3 on the entry side and the strip drive 4 on the exit side with the immediate arrangement of a computer in such a way that the degree of loading of the storage sections 1*a*, 1*b*, 1*c* remains approximately equal. The tension drives 5*a*, 5*b*, 5*c* for the roller tables 9*a*, 9*b*, 9*c* or the looping carriages 10*a*, 10*b*, 10*c* are of identical construction. The roller tables 9*a*, 9*b*, 9*c* or the looping carriages 10*a*, 10*b*, 10*c* are operated synchronously. When deviations from the synchronous operations occur, the tension drives 5*a*, 5*b*, 5*c* influence the speed-controlled strip drives 3, 4 and the intermediate strip drives 7, 8 through the computer in the appropriate manner, so that the synchronous operation is again restored.

In the following example, based on strip entry speed of $V_E$700 m/min and a strip exit speed of $V_A$300 m/min, the following storage operations are explained:

Loading the storage unit;

Unloading the storage unit; and

Loaded storage unit.

Loading:

$$V_E > V_A$$

$$\Delta V = V_E - V_A = 400 \text{ m/min},$$

$$V_1 = V_{E-\frac{1}{3}\Delta V} = 566.66 \text{ m/min},$$

$$V_2 = V_{E-\frac{2}{3}\Delta V} = 433.33 \text{ m/min},$$

(based on three storage sections).

Unloading:

$$V_E < V_A \text{ and } V_E = 0$$

$$\Delta V = V_A = 300 \text{ m/min},$$

$$V_1 = \Delta V - \tfrac{2}{3}\Delta V = 100 \text{ m/min},$$

$$V_2 = \Delta V - \tfrac{1}{3}\Delta V = 200 \text{ m/min}.$$

Storage unit loaded:

$$V_E = V_1 = V_2 = V_A = 300 \text{ m/min}.$$

While specific embodiments of the invention have been shown and described in detail to illustrate the application of the inventive principles, it will be understood that the invention may be embodied otherwise without departing from such principles.

We claim:

1. A strip storage arrangement comprising:

a strip storage unit for continuously passing a metal strip formation of loop strands and having an entry, and exit and at least two storage sections arranged between said entry and said exit of said strip storage unit;

two speed-controlled strip drives located at said entry and said exit of said strip storage unit, respectively; and a speed-controlled strip intermediate drive located between said at least two storage sections;

wherein each of said at least two storage sections includes a movable support for supporting the loop strands and operating synchronously with a movable support of another of said at least two storage sections, and an adjustable tension drive for maintaining a tension of the loop strands at a preset nominal value and for generating a control signal, upon an asynchronous operation of said movable supports of said at least two storage sections, for changing a speed of at least one of said strip drives and said strip intermediate drive for restoring synchronous operation of said movable supports;

wherein each of said at least two storage sections can be operated with different strip tensions, while the synchronous operation of said at least two storage sections is maintained.

2. The strip storage arrangement of claim 1, wherein said tension drive of each of said at least two storage sections are identical.

3. The strip storage arrangement of claim 1, wherein said strip storage unit is formed as a vertical storage unit, and wherein said movable supports of said at least two strip storage sections comprise roller tables arranged consecutively.

4. The strip storage arrangement of claim 1, wherein said strip storage unit is formed as a horizontal storage unit, and wherein said movable supports of said at least two strip storage sections comprises superimposed looping carriages.

* * * * *